US006454196B1

(12) United States Patent
Parke

(10) Patent No.: US 6,454,196 B1
(45) Date of Patent: Sep. 24, 2002

(54) COMMINUTION DEVICES

(76) Inventor: Terrence James Parke, 16 Cameron Court, Toolern Downs, Melton VIC 3337 (AU)

( * ) Notice: Subject to any disclaimer, the term of this patent is extended or adjusted under 35 U.S.C. 154(b) by 0 days.

(21) Appl. No.: 09/600,448

(22) PCT Filed: Jan. 15, 1999

(86) PCT No.: PCT/AU99/00024

§ 371 (c)(1),
(2), (4) Date: Jul. 17, 2000

(87) PCT Pub. No.: WO99/36177

PCT Pub. Date: Jul. 22, 1999

(30) Foreign Application Priority Data

Jan. 16, 1998 (AU) ..... PP1355/98

(51) Int. Cl.[7] ..... B02C 18/18
(52) U.S. Cl. ..... 241/224; 241/236
(58) Field of Search ..... 241/DIG. 31, 236, 241/224, 285.1, 285.2, 285.3

(56) References Cited

U.S. PATENT DOCUMENTS 4,330,092 A 5/1982 Roman
5,236,139 A 8/1993 Radtke

FOREIGN PATENT DOCUMENTS

GB 2 300 131 A 10/1996
WO WO 79/01002 11/1979

*Primary Examiner*—Mark Rosenbaum
(74) *Attorney, Agent, or Firm*—Burr & Brown

(57) ABSTRACT

A shredder (2) for shredding a variety of different materials includes a fixed framework provided with a cutting assembly (20) having at least two counter-rotating cutting arrays (22, 24) each comprising a plurality of cutters (46) and a movable framework provided with a tensioning arrangement (100) for applying the same tension to each of the cutting arrays (22, 24) to shred material fed to the cutting arrays (22, 24) by a telescopically sided chute (10) having a tapering mouth (14) and a throat (16). The movable framework is movable with respect to the fixed framework in accordance with operation of an adjustment means (102) to alter the tension applied to the cutting arrays (22, 24) in order to apply constant tension to the cutting elements (46) to compensate for wear of the cutting elements (46) during use of the shredder.

28 Claims, 10 Drawing Sheets

8
58
42
184
180
42
182
190
186
188
40
8

COMMINUTION DEVICES

The present invention relates generally to methods and apparatus for comminuting materials, particular scrap or waste materials. More particularly, the present invention relates to apparatus, appliances, assemblies or installations having a cutting assembly and to methods of using such equipment in which the cutting assembly reduces the size of the material admitted to the equipment, such as for example by shredding. Even more particularly, the present invention relates to apparatus and methods of using the apparatus in which the cutting assembly comprises two counter-rotating, intermeshing cutting arrays having a plurality of individual cutters in which the tension applied to the cutting arrays is adjustable to take into account wearing of the cutters, particularly by moving an assembly containing the tensioning means with respect to the cutting assembly. Even more particularly, the present invention relates to apparatus having a fixed framework on which is provided the cutting assembly and a movable framework on which is provided the tensioning assembly arranged in such a manner that movement of the movable framework allows adjustment of the tension applied to the cutting assembly by the tensioning assembly. Although the apparatus of the present invention may be used to comminute a wide variety of different materials into pieces of different sizes and shapes, the present invention finds particular application in reducing used tyres to small sized chunks.

Although the present invention will be described with particular reference to an installation for reducing the size of tyres or other waste or recyclable materials, it is to be noted that the scope of the present invention is not restricted to the described arrangement, but rather it is more extensive to include other forms of the equipment, other uses and other methods.

Further, it is noted that although the present invention will be described with reference to a shredder and the process of shredding, the scope of the invention is not limited to shredding but includes other operations of size reduction, such as slicing, cutting and the like.

As time goes by, there is a greater emphasis on recycling waste materials and to be more efficient in the use of recycled materials.

There is also a need to reduce the size of waste material pieces being discharged to landfills, since smaller sized particles or pieces can be compacted into smaller volumes. Currently, it is estimated that up to 30% of the volume of waste material used in landfill is air. By reducing the size of the pieces of waste material, the material can be more closely packed together, thereby reducing or eliminating the amount of voids between individual particles of the waste material when buried in landfills or similar. Thus, if the waste material can be compacted further by reducing its size, the amount of waste material that can be buried as landfill for a given site can be considerably increased, thereby effectively increasing the size of that site without increasing the dimensions of the site.

Further, certain types of waste material can be recycled or used in other operations. For example, discarded tyres can be burnt as fuel or otherwise treated to recover constituent chemicals. In one example, tyres are chopped into pieces and burnt as fuel. However, owing to wire being present in the tyres due to their method of construction, the operation of chopping the tyres into pieces is not entirely successful as the wire resists being broken and causes the individual pieces to be interconnected together. Thus, the individual pieces are not entirely separated from each other. This can cause problems in downstream processing, such as, for example, as contamination in furnaces burning the tyre pieces as fuel, which can block the furnace or contaminate products being formed.

Accordingly, it is an aim of the present invention to address the problems of recycling waste materials and/or to provide an apparatus and method enabling more efficient comminution of materials for any purpose.

According to one aspect of the present invention there is provided a cutting device comprising a fixed framework upon which is mounted a cutting assembly comprising a plurality of cutters and a framework movable with respect to the fixed framework, said movable framework being provided with a tensioning arrangement for maintaining the cutters under tension, wherein the movable framework is movable so as to be selectively positioned with respect to the fixed framework to adjust the tension applied to the cutters, such as for example to take into account wear of the cutters in use.

According to another aspect of the present invention there is provided a shredder comprising a fixed support for supporting two counter-rotating cutting arrays in which each array comprises a plurality of cutters, a movable support upon which a tensioning device is mounted, and an adjustment means interconnecting the fixed support and the movable support, said movable support being movable with respect to the fixed support in response to operation of the adjustment means to adopt a selected position so that tension applied to individual cutters of both arrays is maintained by the tension device at a preselected level, such as for example to take into account wear of the cutters in use.

Typically, the cutters are circular, elliptical, eccentric or other suitable or desirable shape. Typically, there are two cutting arrays, each array comprising a plurality of individual cutters. More typically, the cutters of one array are located intermediate cutters of the other array to form an intermeshing arrangement. Typically, the intermeshing arrangement extends along the length of the cutting arrays.

Typically, the movable support or framework of the present invention includes two plates arranged substantially at right angles to each other. More typically, the vertical plate contains the adjustment means, whereas the horizontal plate contains the or part of the tensioning means. Even more typically, the tensioning means comprises two portions, each portion fixed to respective horizontal plates in which one plate is movable and the other is fixed. One part of the tensioning means applies tension to one array and the other part of the tensioning means applies tension to the other array.

Typically, the two parts of the tensioning means are interconnected by a drive shaft, preferably a telescopic drive shaft, so that movement of the shaft simultaneously controls the amount of tension applied by both parts of the tensioning means.

Typically, the two parts of the tensioning means interconnected by the telescopic shaft are driven by a single motor means, such as for example a hydraulic motor. Even more typically, the same tension is applied to both cutting arrays by two tensioning devices operated by the same hydraulic motor.

Typically, the adjustment means mounted on the vertical plate comprises screw jacks. Typically, the screw jacks are provided with sprockets. More typically, an endless chain collectively engages all sprockets of the screw jacks to simultaneously adjust the position of the movable support or frame with respect to the fixed support or frame. Even more typically, the screw jacks interconnected the fixed framework and the movable framework so that operation of the screw jacks effects movement of the movable framework with respect to the fixed framework, thereby altering the tension applied by the tensioning means.

Typically, each cutting array is supported by one or more bearings. More typically, each cutting array is supported at a location intermediate its ends by the bearing arrangement. Even more typically, each cutting array is supported by the bearing arrangement about the mid-point of each respective array. Even more typically, the bearing arrangement is a slideable bearing arrangement.

Typically, the slideable bearing arrangement comprises an eccentric shaft. More typically, the eccentric shaft oscillates in use to remain clear of the cutting arrays in use. Even more typically, the cutting arrays are provided with individual cutters in which selected ones of the individual cutters contact part of the eccentric shaft to maintain the shaft free of the rotating cutters in use.

Typically, the tensioning device is a coiled torsion spring. More typically, there are two coil torsion springs, one spring for applying tension to one of the arrays, the other spring for applying tension to the other array.

Typically, the cutters are provided with surface irregularities. More typically, the surface irregularities include cleats. Even more typically, one form of the cleat is a plurality of raised blocks located at regularly spaced apart locations around the circumference of the cutter. Even more typically, the cleats are provided with transverse grooves and with circumferentially extending grooves. Even more typically, grooves are provided in the spaces between adjacent cleats. Even more typically, the grooves are axially extending grooves.

Typically, the movable assembly is movable over a linear distance of up to one metre, typically up to 750 millimetres, and more typically up to 600 millimetres.

More typically, the direction of movement is axial with respect to the longitudinal direction of the cutting arrays.

Typically, each cutting array is provided with a drive shaft journalled in a bearing at each end. More typically, the bearing is a multiple bearing comprising at least two bearings arranged in opposed face to face relationship with respect to each other, with one bearing being located within the other, thereby allowing movement of the shaft deviating from alignment along the central axis.

The present invention will now be described by way of example with reference to the accompanying drawings in which.

Figure 1:
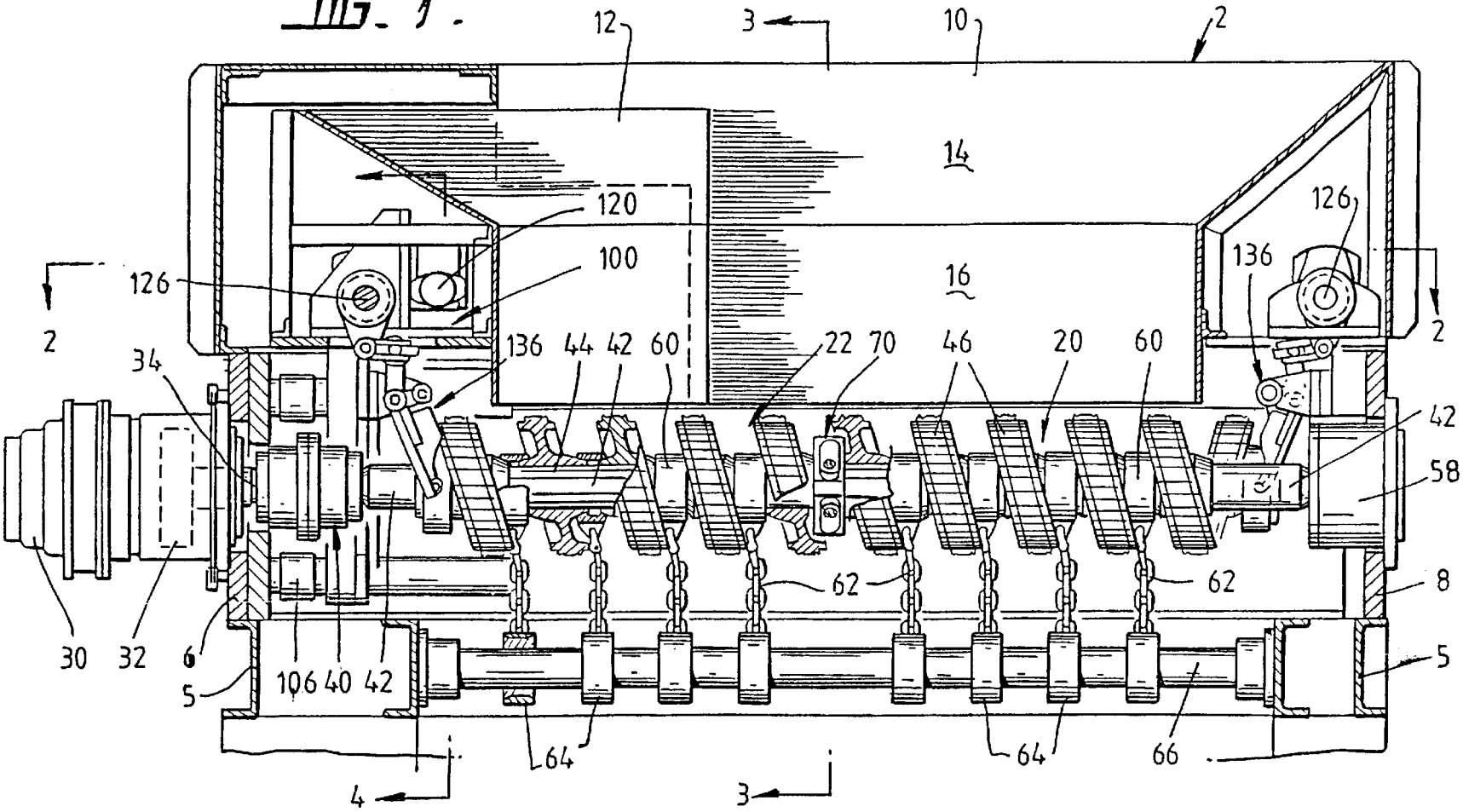
FIG. 1 is a partial vertical cross-sectional side view of one form of the apparatus of the present invention showing the general relationship of many of the components.
Figure 2:
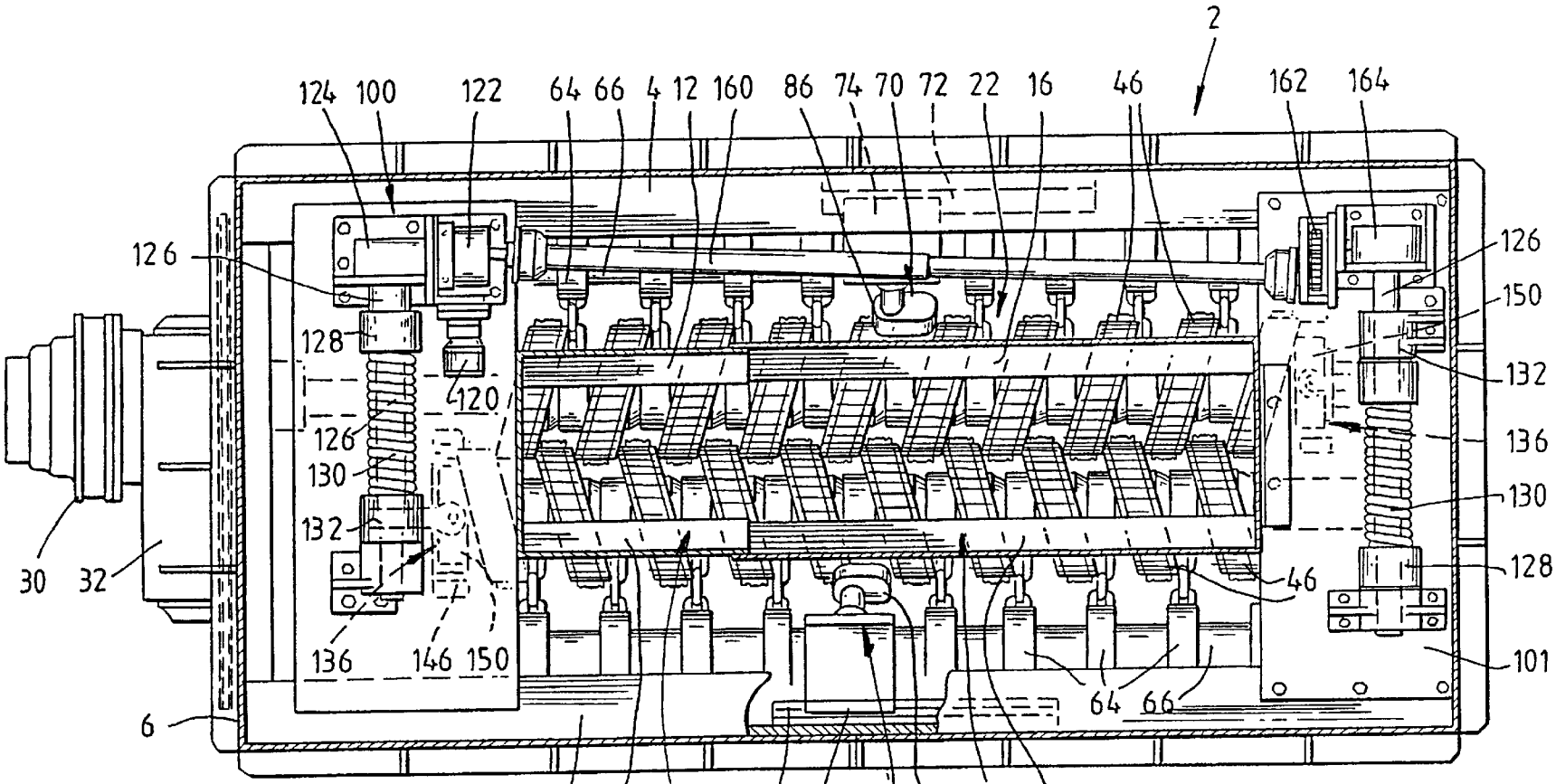
FIG. 2 is a horizontal cross-section taken along the line 2—2 of FIG. 1 showing the two cutting assemblies in side by side relationship.

In the Figures, there is shown a shredder, generally denoted as 2, made in accordance with the present invention for shredding material, such as waste or recyclable material, particularly used car, truck and motorcycle tyres, into relatively small sized pieces from which the constituent chemicals can be recovered or which can be used as a convenient fuel.

The shredder is made up of a number of different assemblies, some of which are fixed and some of which are movable with respect to the fixed assemblies in order to adjust operating parameters of the shredder, such as for example the tensioning devices applying tension to the shredder to compensate for wear to the cutters or similar over time or as a result of use.

The assemblies can be broadly sub-divided into a fixed main framework comprising a rotating cutting assembly provided with anti-wrap members and a movable framework comprising a tensioning assembly for maintaining the cutting assembly under constant tension irrespective of the amount of wear to the cutting assembly.

It is to be noted that the use of the terms "upper", "lower", "top", "base", "vertical", "horizontal" or the like in the following description refers to the normal, in use position of the apparatus for ease of description and clarity of understanding, and is not meant to be limiting.

Shredder 2 comprises a main framework which is fixed and forms the main structure and support for the shredder. The fixed framework comprises four lengthwise extending rails 4, two of the rails being top rails and two of the rails being lower rails, two girders 5 located underneath the lower rails, and two end plates 6, 8 transversely connected to the ends of the rails and girders to form a substantially rectilinear, fixed and rigid framework. Other structural members may be optionally provided. Doors, coverplates, shrouds and the like (not shown) are connected to the framework at various locations to fill in the area between the rails 4, girders 5 and end plates 6, 8 for reasons of safety of operation of the shredder and to protect the working parts of the shredder. The doors etc which provide easy access internally into the apparatus are not shown in the drawings for clarity of illustration of the components of the shredder. A fixed, generally U-shaped inlet chute 10 having an open end facing inboardly is located on top of one end of the top rails 4 to allow waste material to be admitted to the shredder 2 for processing. The fixed inlet chute 10 comprises upper tapered side sections 14 and lower vertical side sections 16. A generally U-shaped movable portion 12 having one open side forms the other end of the inlet chute 10 by closing the open end of fixed portion 10 since the opening of chute 12 oppositely faces the opening of inlet chute 10. Portion 12 is telescopically received in fixed portion 10 to complete the chute and allow movement of chute 12 with respect to chute 10. In use, movable portion 12 moves telescopically within inlet chute 10 when the position of the tensioning assembly is adjusted. Movable portion 12 is provided with tapered upper sides corresponding to the tapered upper sides of fixed portion 10 and nested therewithin and with lower vertical sides corresponding to the lower vertical sides of the fixed potion and nested therewithin. Movable portion 12 axially moves with respect to the fixed portion 10 so that the tapered and lower sides move respectively with respect to the corresponding tapered and lower sides, as will be described in more detail later so that no matter what position the tensioning assembly adopts with respect to the main frame, a complete inlet chute is always defined. The opening of the chute receives material for shredding, such as for example whole tyres or the like, whilst the tapered side sections 14 direct the material towards the cutting assembly 20 for more efficient shredding.

Material admitted to the inlet chute 10 falls onto a cutting assembly 20 comprising two counter-rotating cutting arrays 22, 24 arranged in parallel relationship to each other, whereupon it is shredded into smaller sized pieces which fall through the open base portion of the shredder into a receiving hopper or similar arrangement such as a conveyor, for removing the shredded material to a remote location.

The cutting sub-assembly 20 of shredder 2 can be driven by a number of different alternative motors, such as for example by electric motor, hydraulic motor, or internal combustion or diesel motor. A typical motor employed in powering shredder 2 is a diesel engine coupled to a hydraulic motor. For the sake of clarity of illustration and ease of descriptive, the present invention will be described with reference to a diesel motor driving ancillary equipment to power a hydraulic motor 30 located at one extreme end of shredder 2 outboard of plate 6. Hydraulic motor 30 is coupled to a transmission 32 at one end of shredder 2. Gearbox 32 is arranged to provide spaced apart and intermeshed output drives 34 which rotate simultaneously in opposite directions in use. The distal end of each output drive 34 is coupled to a suitable coupling in the form of a multiple main bearing or similar 40, which will be described in more detail later. Each multiple main bearing 40 is connected to a generally square section main shaft 42 having rounded corners 44 between the flat sections, which shafts are the main drive shafts for the shredder. One cutting array is associated with one of the shafts while the other cutting array is associated with the other shaft.

A plurality of identical cutters 46 are arranged on each main shaft 42 in abutting relationship to form each array. In one embodiment of the shredder there are ten separate cutters 46 located on each main shaft 42. As both shafts and cutters form arrays which are substantially mirror images of each other about the plane through the portions of the cutters of one shaft which operatively mesh with cutters on the other shaft, apart from the positioning of the thrust bearing (to be described in more detail later), only one cutter array will be described in detail.

Figure 9:
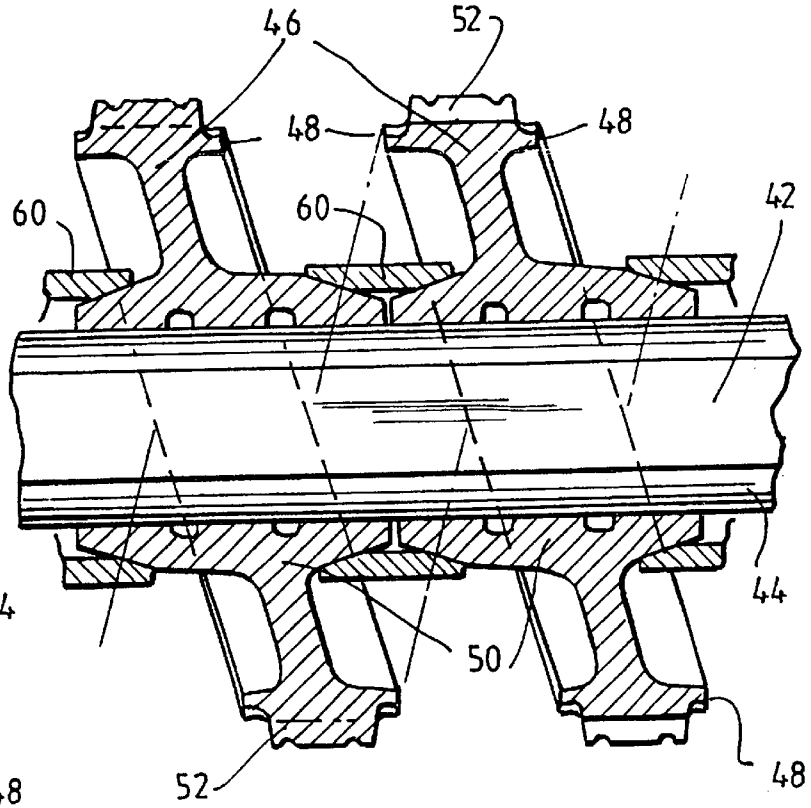
FIG. 9 is a similar view to that of FIG. 8 showing the cutters in a worn condition.
Figure 8:
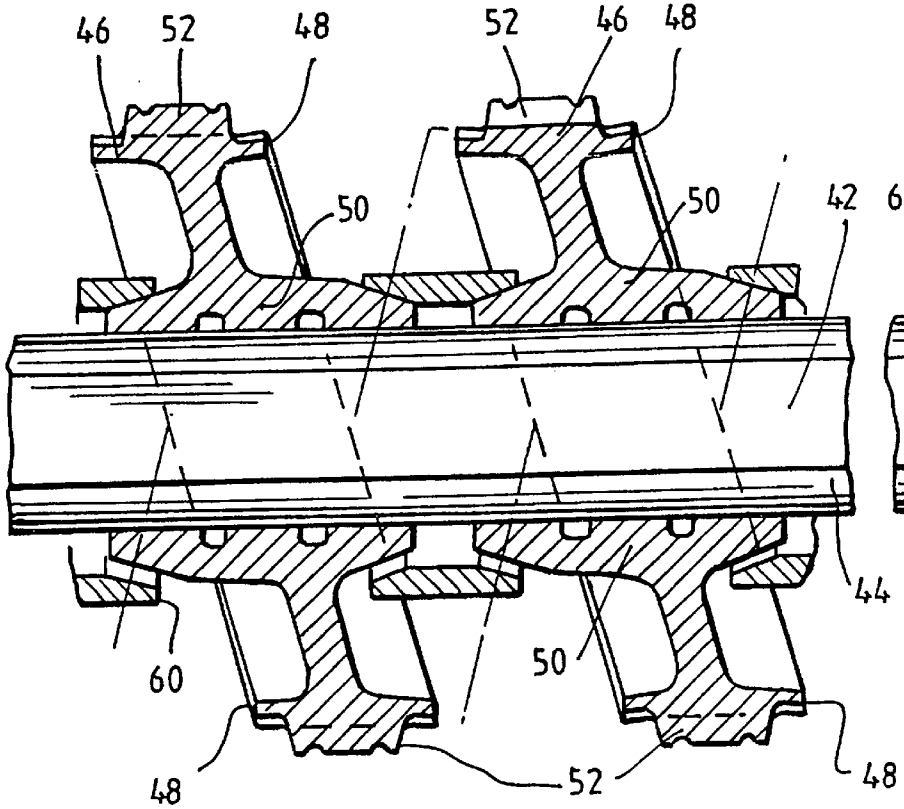
FIG. 8 is a cross-sectional view of two adjacent cutters of the same cutting assembly when the cutters are relatively new.
Figure 10:
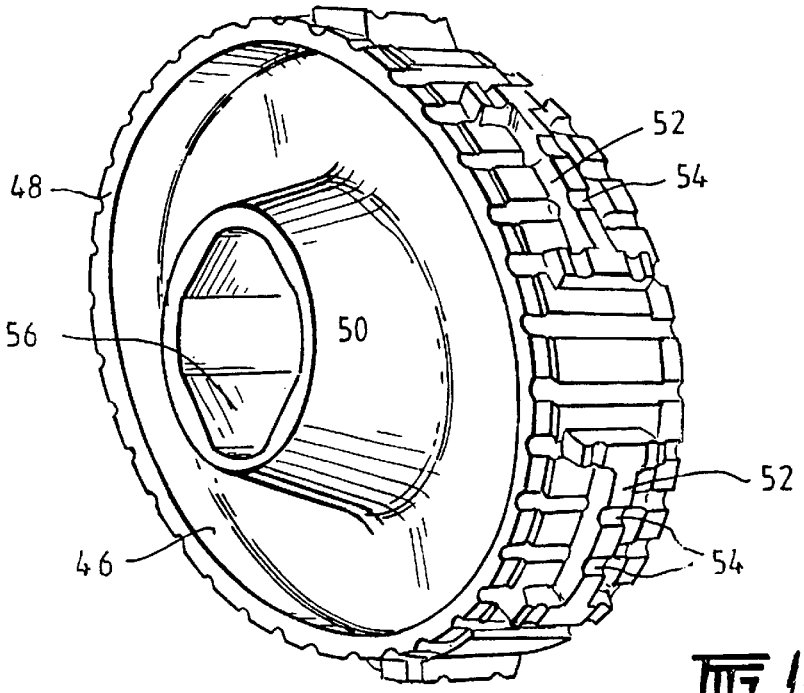
FIG. 10 is a perspective view of one form of the cutter.
Figure 11:
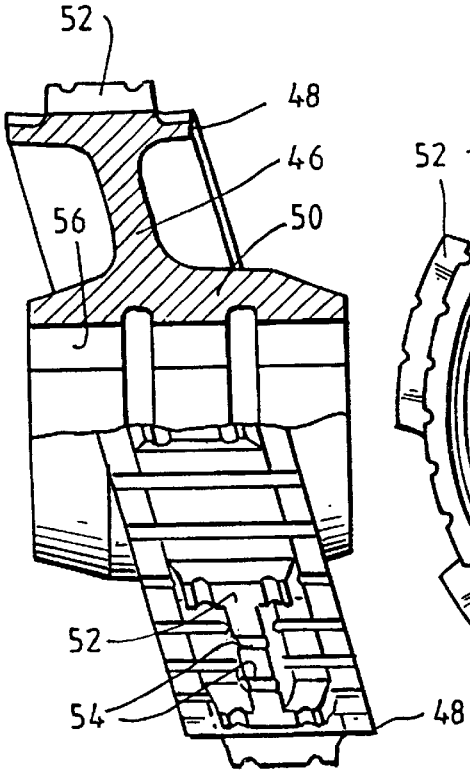
FIG. 11 is a partial transverse cross-sectional view of the form of the cutter of FIG. 10.
Figure 12:
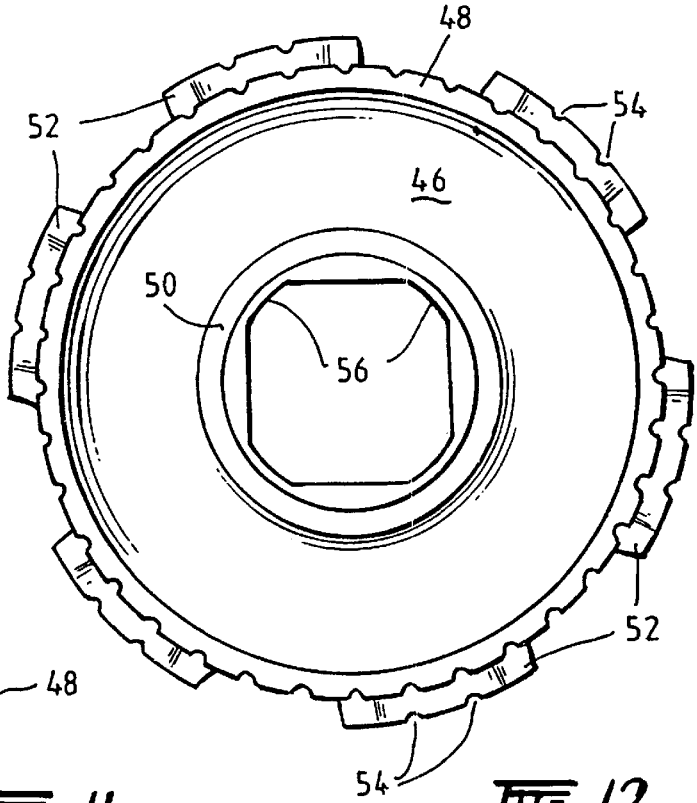
FIG. 12 is an axial view of the cutter of FIG. 10.

With particular reference to FIGS. 8 to 12, each cutter 46 is provided with two cutting edges 48 located on either side of the circumferential portion of the cutter. The cutting surfaces 48 extend circumferentially around a central hub portion 50. The outer circumferential edge of the cutter located intermediate the cutting edges 48 is provided with a plurality of cleats 52 in the form of raised blocks having transversely extending grooves 54 as well as being provided with a series of transverse grooves in the spaces between adjacent blocks. The planes containing each of the cutting surfaces 48 are angularly inclined to the central axis of the hub 50 of the cutter. The hub portion 50 of each cutter comprises a number of flat sections (flats) 56 which are complementary in shape to the flat sections of the main shaft 42 so that when the cutter is located on the main shaft it is driven by rotation of the main shaft since the flat sections of the main shaft are in contact with corresponding flats 56 of the hub of the cutter. Each cutter 46 is oriented on its main shaft 42 so that cleats 52 of one cutter are positioned intermediate the cleats of two adjacent cutters when the cutters are in intermeshing relationship, so that when the cutters counter-rotate the cleats intermesh in turn to assist in grabbing and holding material introduced into the shredder as it is shredded, to aid the efficiency of the shredder. The cutters are located on the main shaft so that adjacent cutting surfaces 48 of adjacent cutters 46 on the two side by side parallel shafts contact each other to perform the shredding. As the cutters rotate, the cutting surfaces of the adjacent cutters remain in contact with each other over the length of the arc corresponding to the cutters being in intermeshing relationship. It is to be noted that in this orientation when the cutters are relatively new, the hub portions of adjacent cutters do not abut against each other, but rather there is a gap between the hubs of adjacent cutters as shown in FIG. 8. The cutters are maintained in this spaced apart spatial arrangement by tension applied to the cutters from a tensioning assembly including the thrust bearing which will be described in more detail later so that the cutting surfaces are in abutting relationship. During use of the shredder, the cutting surfaces 48 are ground away by their continual contact with adjacent cutting surfaces, since not only are the cutting surfaces in contact to shred material therebetween, but also to effect self-sharpening of the surfaces which facilitates efficient operation of the shredder. As the surfaces 48 are worn away, the hubs 50 of adjacent cutters on the same shaft move closer together until they contact each other or nearly so, as shown in FIG. 9, which signals the cutters being at the end of their useful working lives. However, as the hubs move closer together, the tension applied thereto becomes less and needs to be periodically readjusted. The relationship between the fixed framework supporting the cutting array of cutters and the movable framework supporting the tensioning means allows the tension to be adjusted and thus maintained at a substantially constant value during operation of the shredder to take into account this wear.

Figure 13:
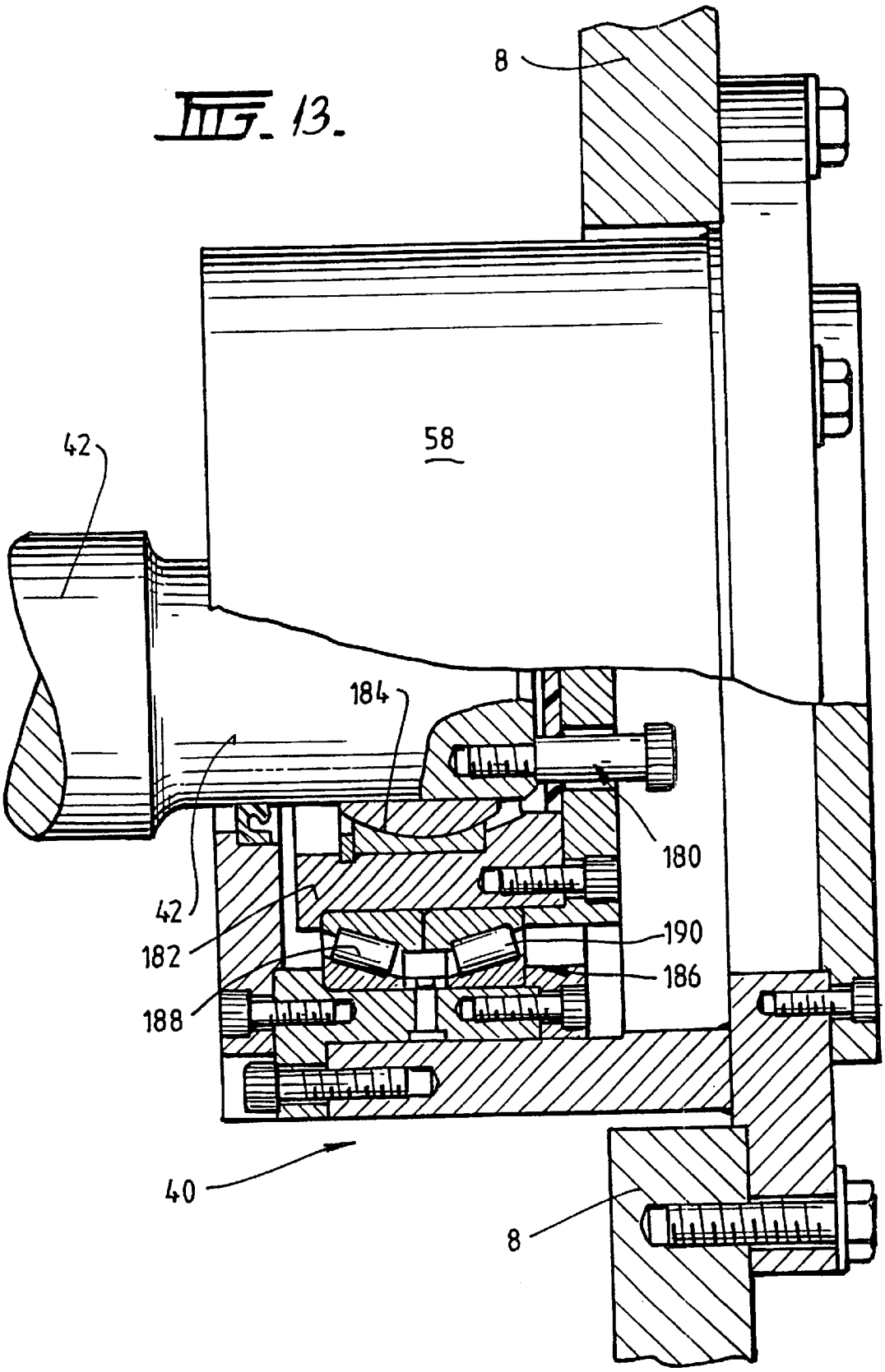
FIG. 13 is a partial cross-sectional view of one form of the main bearing supporting the drive shaft of the cutting array.

Returning now to the description of the remainder of the shredder, the other ends of each of the main drive shafts 42 are journalled in suitable bearings 58 located in end plate 8 at the other end of shredder 2. In one form, the bearing is a multiple bearing similar to that of main bearing 40. One form of the multiple bearing 40, 58 is shown in FIG. 13. Bearing 40 comprises inner bearing 180 which interconnects main shaft 42 and allows rotation thereof with respect to housing 182 by suitable means, such as rollers 184 or similar. Outer bearing 186 is located externally of inner bearing 180 and comprises rollers 188, 190 arranged in angularly inclined relationship to allow inner bearing 180 to flex off axis with respect to outer bearing 186. Thus, this arrangement of a bearing within a bearing allows the main shaft 42 to flex under heavy loads during operation so the amount and direction of movement away from the at rest position afforded by this arrangement means that the shredder does not stall or suffer damage should an unusual operating condition be encountered, such as a foreign object becoming lodged between the two cutting arrays and/or the two parallel shafts 42.

Figure 3:
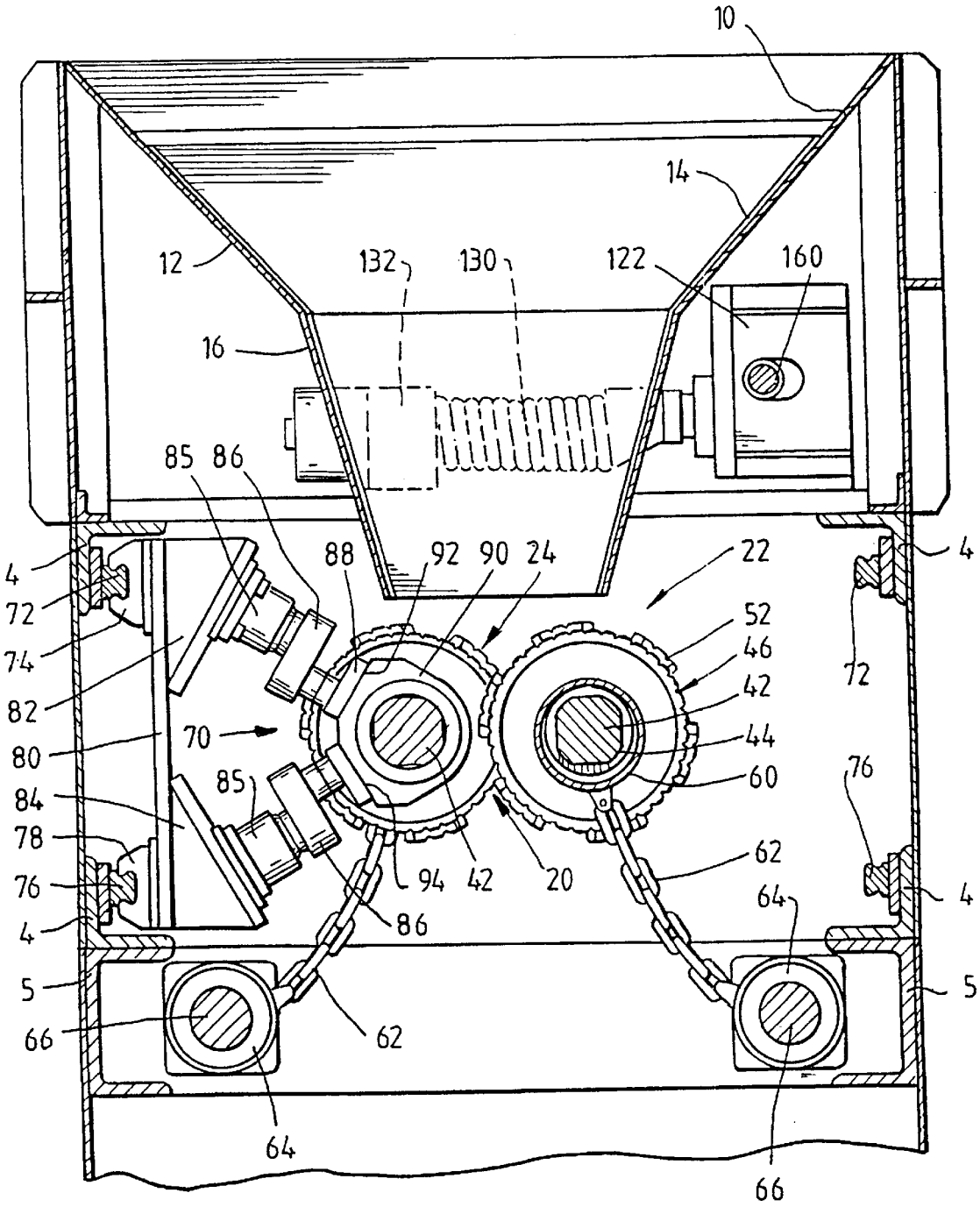
FIG. 3 is a vertical cross-section taken along the line 3—3 of FIG. 1 showing details of the sliding bearing arrangement.
Figure 4:
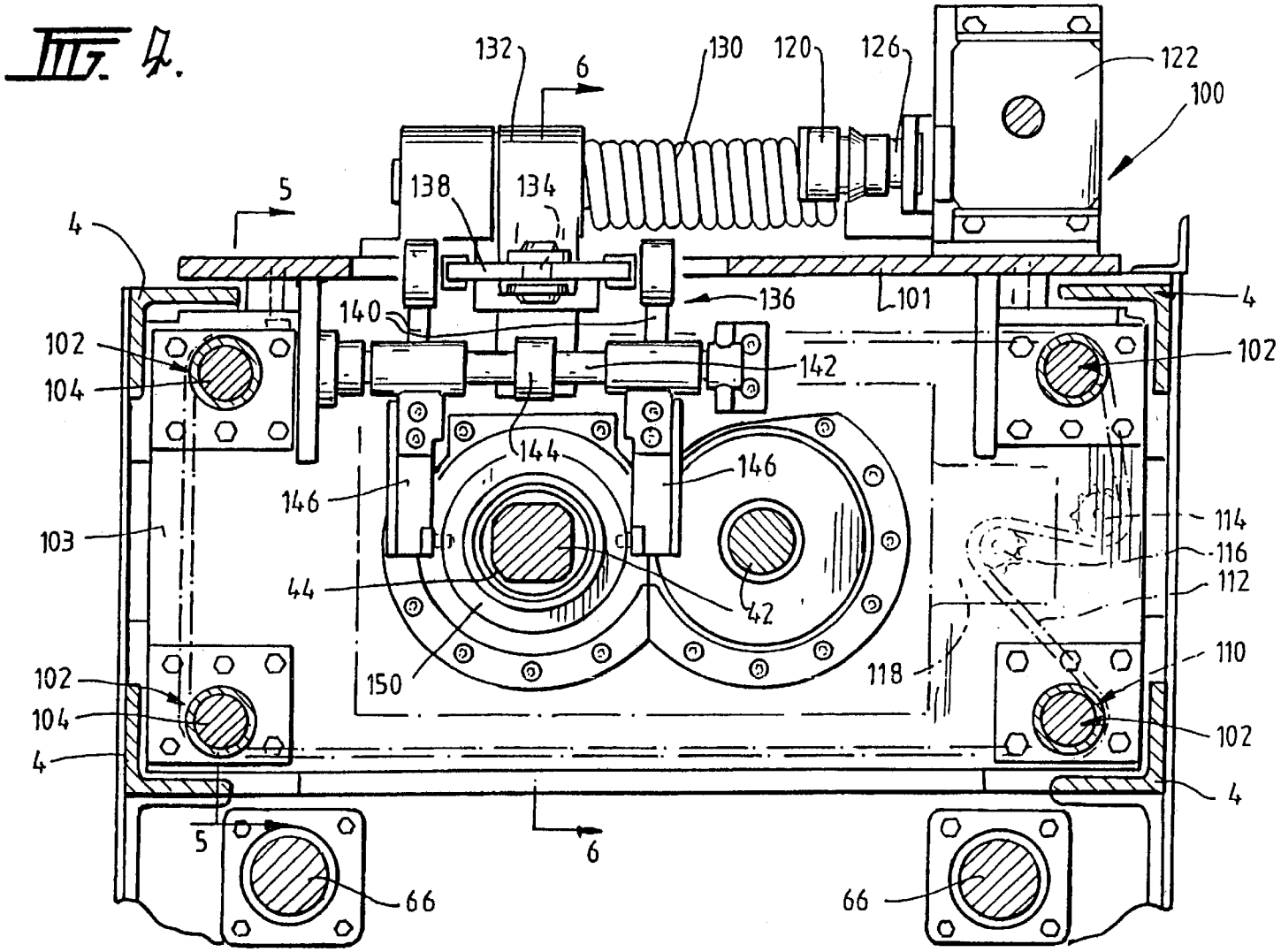
FIG. 4 is a vertical cross-section taken along the line 4—4 of FIG. 1 showing details of the slideable tensioning assembly.
Figure 5:
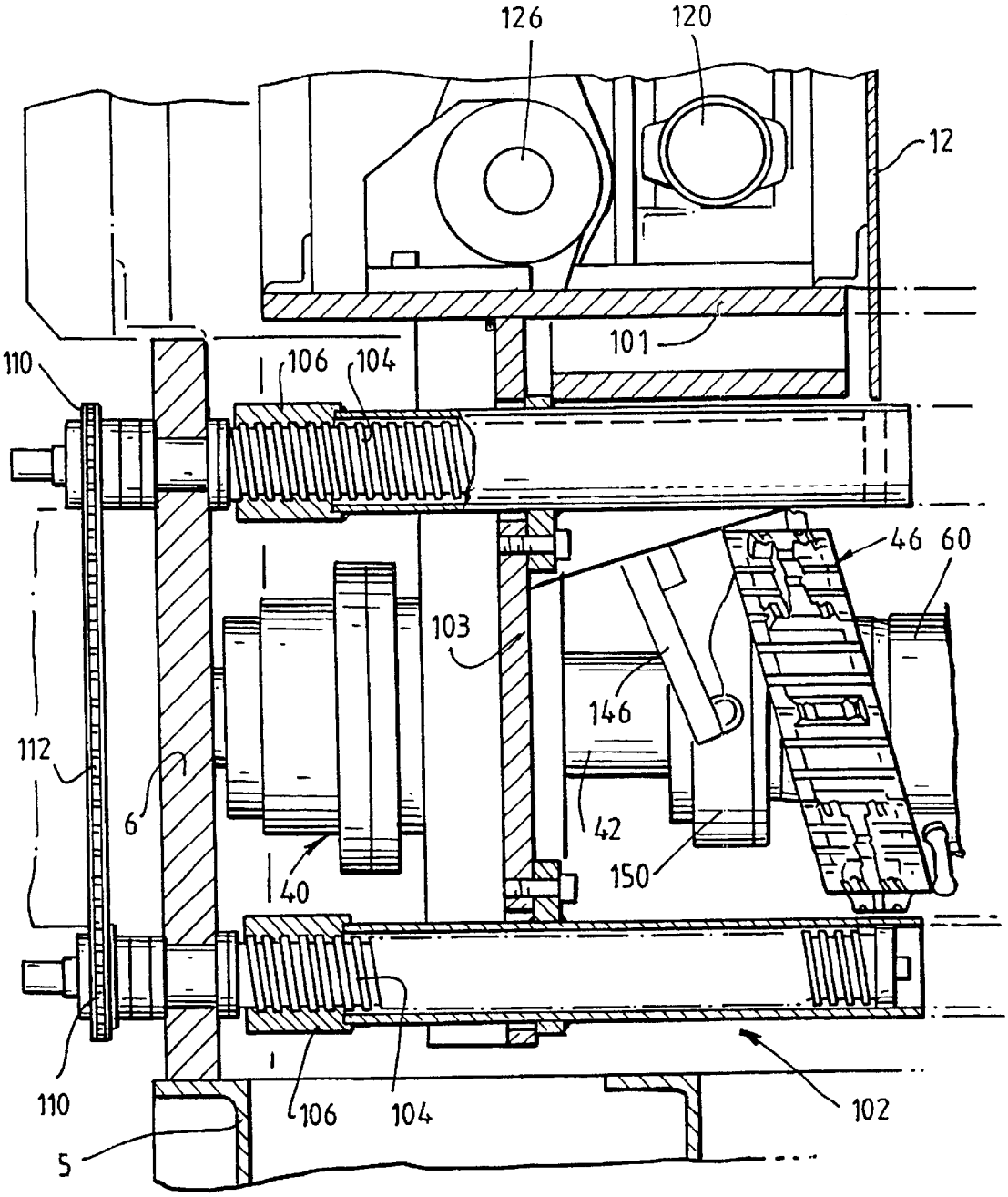
FIG. 5 is a vertical cross-sectional view taken along the line 5—5 of FIG. 4 showing side on details of the tensioning assembly.
Figure 6:
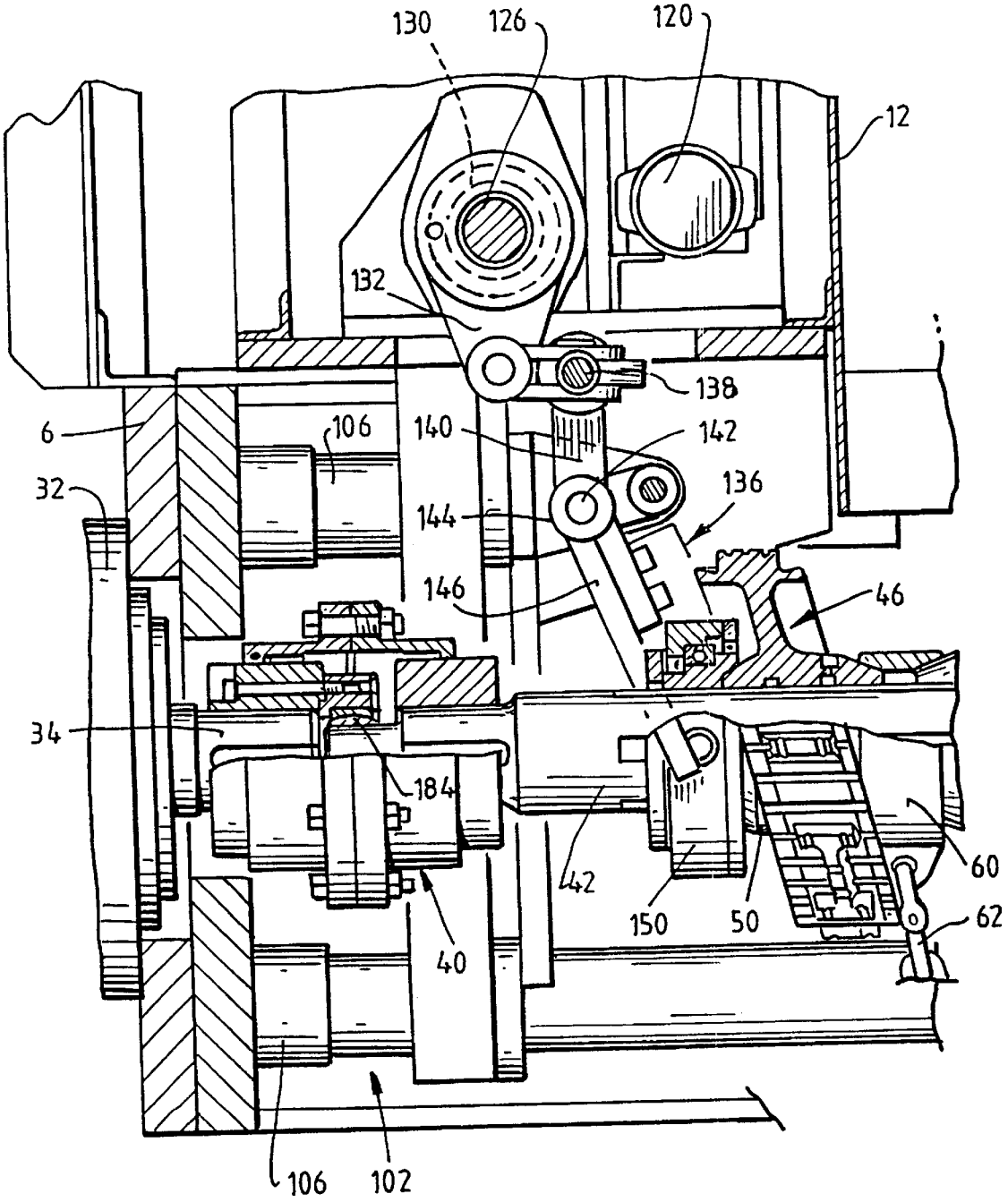
FIG. 6 is a vertical cross-sectional view taken along the line 6—6 of FIG. 4 showing further details of the tensioning assembly.
Figure 7:
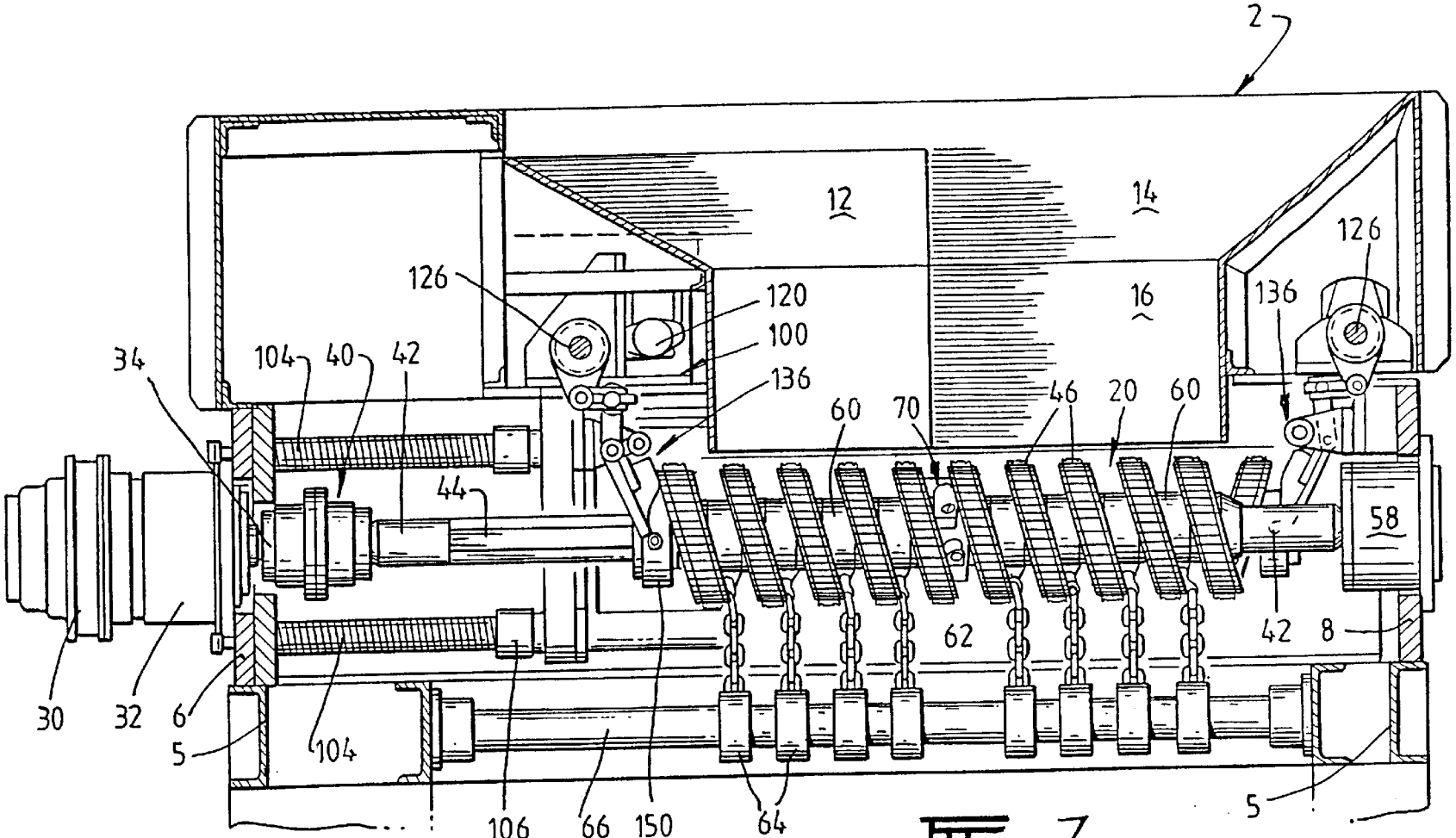
FIG. 7 is a vertical cross-sectional view of the apparatus of the present invention in a position compensating for wear to individual cutters of the cutting sub-assembly.

With particular reference to FIGS. 1 and 3, between each adjacent cutter on the one shaft 42 is located a loose fitting collar 60 having tapered end portions for fitting over the hub portions 50 of the cutters 46. One end of a diverting chain 62 is connected to a suitable fastening point provided on collar 60 and the other end of the diverting chain 62 is connected to a suitable fastening point on a further collar 64 which is received on a stationary rod 66 extending lengthwise along the shredder between girders 5. In use, the further collar 64 is free to slide axially up and down on the fixed rod 66 as the cutter rotates to anchor one end of the diverting chain 62 whilst being clear of the rotating cutters. The diverting chain 62 forms an anti-wrap member to divert material being shredded by the shredder from continually wrapping around the cutter and main shaft. The diverting chain directs any material with a tendency to wrap around the main shaft 42 and cutters 46 towards the open bottom of shredder 2 for removal from the shredder.

Midway along the length of the main shaft 42 is a slideable bearing arrangement 70 for providing support to the main shafts 42 and preventing the shafts from being forced away from each other during operation of the device, particularly when material which is difficult to cut or foreign material is lodged between the shafts in use.

The slideable bearing 70 will now be described in more detail. It is to be noted that whilst there is a slideable bearing supporting each main shaft 42, the slideable bearings are mirror images of each other so that only one bearing will be described. Similarly, the upper and lower parts of each bearing are the same except for their direction of orientation and the direction in which the bearing force is applied so that only the upper part of one of the slideable bearings will be described in full.

With particular reference to FIG. 3, the slideable bearing arrangement 70 comprises an upper rail 72 upon which an upper jaw member 74 is interlockingly received and a lower rail 76 upon which a lower jaw member 78 is interlockingly received. The upper and lower jaw members 74, 78 are free to slide axially along the respective upper and lower rails 72, 76 in the lengthwise extending direction of the shredder. The upper and lower jaw members 74, 78 are each connected to a vertical support plate 80 which is provided with a generally triangular-shaped upper support bracket 82 and a generally triangular-shaped lower support bracket 84. The upper triangular support bracket 82 is provided with a bearing housing and bearing 85 in which one end of an eccentric crank 86 is journalled. Eccentric crank 86 comprises two opposed shanks extending outwardly from the central body portion along two axes which are off-set to each other. The other end of eccentric crank 86 is journalled in a further bearing and housing 88 which is connected to one of the flat surfaces 92 of a bearing block 90. The bearing block 90 houses a bearing internally therein within which the main shaft 42 is journalled for rotation, thus providing support for the main shaft as it rotates. A similar support arrangement is provided underneath the level of the main shaft 42 by extending from the other flat surface 94 of bearing block 90 through a further eccentric shaft 86 via two sets of bearings and housing to lower triangular bracket 84. The sliding bearing arrangement supporting the other main drive shaft is similar. The two shafts 42 are thus held securely in place by the two slideable bearings.

The eccentric cranks 86 oscillate in unison with rotation of the cutter by the hub portion 50 of the cutter 46 contiguous with the eccentric shaft contacting one side of the shank of the eccentric crank closer to main shaft 42 to cause it to move away as the cutting edge 48 comes close to it and then to move back in the other direction as the cutter continues to rotate by the adjacent cutter 46 contacting the other side of the shank, so that the eccentric shaft first moves in one direction and then in the other direction to keep out of the way of the rotating cutter at all times as the cutter rotates. Movement of the eccentric crank 86 is facilitated by oscillation of vertical plate 80 and jaw members 74, 78 along upper and lower rails 72, 76. Thus, the slideable bearings oscillate backwards and forwards in the axial direction as the main shafts rotate whilst maintaining support for the main shafts to prevent them from separating from each other and lowering the efficiency of the shredder.

Turning now to the movable assembly of the shredder 2 containing part of the tensioning assembly, it can be seen, with particular reference to FIGS. 2 and 4 to 7, that the tensioning assembly 100 is located on the upper surfaces of the two spaced apart longitudinally extending top side rails 4 of the framework. The assembly is axially movable in the longitudinal direction of the shredder to compensate for wear in the cutting surfaces 48 of the cutters 46 forming part of the cutting assembly 20. The tensioning assembly is mounted on its own support and its position with respect to the main frame is adjustable by the use of adjustment means.

The tensioning assembly 100 comprises two substantially perpendicularly arranged plates connected to each other to form the base of the movable framework of the tension assembly. The horizontal plate 101 rests on top of the top rails 4 in grooves (not shown) provided to allow the plate 101 to slide longitudinally whilst being supported. The vertical plate 103 depends downwardly from the horizontal plate 101 and contains the adjusting mechanism used to move the movable framework with respect to the fixed framework. Movable inlet chute 12 is fixedly attached to the top of the horizontal plate 101 and accordingly moves with respect to fixed inlet chute 10 when plate 101 moves.

Four screw jacks 102 are located at spaced apart locations towards the four corners of end plate 6 to interconnect the movable framework to the fixed framework. Each screw jack 102 comprises an outer covering providing protection for an externally threaded internal shaft 104 which threadingly engages with a captive nut 106 or similar fixedly connected to vertical plate 103 so that rotation of the threaded shaft 104 causes the nut 106 to travel lengthwise along the threaded shaft 104 in order to adjust the position of the assembly with respect to the main frame. The outboard ends of each screw jack 106 extending outwardly from plate 6 are provided with a sprocket wheel 110 or similar collectively about which is received an endless chain 112. The endless chain 112 co-operatively engages each of the four sprockets 110 associated with each of the screw jacks 102, a tension or idler sprocket 114, and a drive sprocket 116 connected to adjustment hydraulic motor 118. Operation of the hydraulic motor 118 causes the drive sprocket 116 to rotate, which in turn causes the chain 112 to move, which in turn drives the sprockets 110 connected to the screw jacks 102 for moving the threaded shaft 104 with respect to the captive nuts 106, which in turn moves plate 101 to adjust the position of the assembly 100 with respect to the main frame of the shredder. Thus, during use of the shredder when the cutting surfaces 48 wear so that cutters 46 are no longer capable of being maintained under the correct tension with the assembly 100 in that position, it is possible to re-tension the cutters to the correct tension by moving the assembly to re-tension the cutters by using the adjustment means as described previously.

Returning now to the top of horizontal plate 101, it can be seen from the drawings that tension control hydraulic motor 120, which is fixedly mounted on the top of plate 101, is connected to a gearbox 122 having two output shafts extending outwardly in opposite lengthwise extending directions therefrom. A bevel gear 124 is connected to one of the output shafts whereas the other output shaft is connected to a telescopic drive shaft 160. The one output shaft from the bevel gear 124 is connected to rotatable axle 126 to which is fixedly connected a retaining collar 128 which rotates in unison with axle 126. Collar 128 is provided with a slot or similar for captively retaining one end of a coil torsion spring 130 which is coiled about axle 126. The other end of spring 130 is held captive in a slot provided in bracket 132 in the form of a freely rotatable collar provided with an extension piece having a bore 134, which collar is free to rotate about axle 126. The other end of axle 126 is journalled in a bearing housing secured to the top of plate 101. Thus, as hydraulic motor 120 rotates, so does collar 128 which loads torsion spring 130 to apply tension to collar 132 which is prevented from rotating due to being connected to a generally H-shaped yoke arrangement 136, part of which is received through bore 134 of collar 132. Yoke arrangement 136 comprises a pin 138 received through bore 134 and extending between apertures provided at the end of two arms 140 securely attached to respective ends thereof. An axle 142 extends between arms 140 more inboardly of pin 138. Axle 142 is received in pivot 144 thus allowing axle 142 to pivot therein which causes corresponding pivoting movement of arms 140. Yokes 146 are arranged as extensions of arms 140 in parallel spaced apart relationship to define a space in which pivotable thrust bearing 150 is pivotally retained. Shaft 42 is received through thrust bearing 150. Thrust bearing 150 bears against hub 50 of the endmost cutter 46 located on shaft 42 so as to maintain all of the cutters on the one shaft under the same tension. Thus, operation of hydraulic motor 120 causes the correct tension to be applied to this cutting array through thrust bearing 150.

Returning now to telescopic drive shaft 160 which extends between gearbox 122 located on plate 101 as described above and to the part of the tensioning means located at the other end of shredder 2 for applying tension to the other main drive shaft 42 by rotation of telescopic shaft 160, it can be seen that the other end of shaft 160 is connected to a gearbox 162 and bevel gear 164 similar to bevel gear 124 located at the other end of shredder 2. The remaining components of this part of the tensioning means are the same as that described previously except that it imparts tension to the cutters on the other drive shaft 42 forming the other cutting array. However, it is to be noted that this second part of the tensioning assembly remains fixed with respect to the main framework upon which it is mounted, hence the reason for telescopic shaft 160 to accommodate movement of plate 101 with respect to this second part of the tensioning device. Thus, by having the telescopic drive shaft 160 interconnecting both parts of the tensioning means to simultaneously apply the same tension to both arrays of cutters by the two separate torsion springs using only a single motor, it is possible to apply the same tension between all of the cutting surfaces of all of the cutters irrespective of which drive shaft they are located on and driven by.

In operation of shredder 2 of the present invention, when cutters 46 are new or nearly so, they are arranged on their respective shafts 42 in a manner as shown in FIG. 8 since the adjacent cutting surfaces 48 of adjacent cutters 46 on adjacent shafts 42 are in contact with each other so that the hubs of adjacent cutters on the same shaft 42 are relatively widely spaced apart from each other. In this position, hydraulic motor 120 is operated to rotate collar 128 on shaft 126 thereby causing torsion spring 130 to twist since both ends of spring 130 are held captive by respective collars. In so doing, tension is applied to collar 132 since it is prevented from movement by the yoke arrangement received in the bore extension of this collar. In turn, tension is applied to thrust bearing 150 which in turn maintains all the cutters on this shaft under the same tension.

Simultaneously, in a similar manner, telescopic shaft 160 is caused to rotate by hydraulic motor 120 to cause tension to be applied to all of the cutters on the other driving shaft. As both torsion springs are controlled from the same hydraulic motor 120, the same tension is applied to both shafts 42 simultaneously. Thus, all of the cutters, irrespective of which shaft they are driven by, are under the same tension.

The diesel engine is started to cause hydraulic motor 30 to operate to drive both driving shafts 42 and all of the cutters 46. Gearbox 32 is so arranged that the two shafts 42 rotate in opposite directions with the cutting edges 48 of all cutters 46 in contact with adjacent cutting edges.

Waste material is introduced to shredder 2 through inlet chute 10 and directed onto the two counter-rotating cutting arrays whereupon the material is reduced to relatively small sized pieces. Cleats 52 provided around the circumferential edge of the cutters help to draw the waste material into the cutters and maintain it there during the actual shredding operation.

As shafts 42 rotate, the four eccentric cranks 86 are caused to oscillate so as to be clear of the rotating cutters in their immediate vicinity yet still provide support, facilitated by the four slideable bearings which also oscillate in accordance with oscillation of the eccentric cranks 86.

Material, after passing through the counter-rotating cutters, has a tendency to continue to rotate and wrap around the rotating cutters. The presence of the diverting chains 62 prevents the material from following the cutters and directs the cut pieces to the base of the shredder for collection and/or subsequent removal.

After shredder 2 has been operating for some time the cutting edges 48 begin to wear away due to constant meshing with the adjacent cutting edges until the tension supplied via the thrust bearing is almost insufficient to keep the cutting edges in contact with each other, thus allowing waste material to pass through the counter-rotating cutters without being properly shredded. At this time, operation of the shredder 2 is stopped and hydraulic motor 120 operated to reduce the amount of tension applied by the torsion springs. Then, hydraulic motor 118 is operated to drive chain 112 to operate screw jacks 102 to move the movable sub-assembly towards the other end of the shredder so as to reduce the distance between plate 103 and plate 8. When the selected position of the sub-assembly has been correctly reached, hydraulic motor 118 is stopped. The movement of the sub-assembly brings thrust bearings 150 into closer contact with the respective endmost cutters on each respective shaft and also assist in tensioning the cutters. Thereupon, hydraulic motor 120 is again operated to further twist spring 130 to increase the tension on the thrust bearing 150 to correctly re-tension all of the cutters on both shafts 42, whereupon the shredder is operated again to comminute the waste material. After further use and wear, the readjustment process is repeated and so on, until there is no further adjustment possible, such as when the hubs of adjacent cutters on the one shaft are abutting against one another or almost so, as shown in FIG. 9. At this stage, the cutters can be replaced.

The described arrangement has been advanced by explanation and many modifications may be made without departing from the spirit and scope of the invention which includes every novel feature and novel combination of features hereindisclosed.

Those skilled in the art will appreciate that the invention described herein is susceptible to variations and modifications other than those specifically described. It. is understood that the invention includes all such variations and modifications which fall within the spirit and scope.

What is claimed is:

1. A cutting device for shredding material into smaller sized pieces including a fixed support for supporting at least two counter-rotating cutting arrays in which each array is provided with a plurality of cutting elements, said cutting elements co-operatively engaging with adjacent cutting elements to shred material located therebetween, a movable support provided with a tensioning means for applying tension to the cutting arrays, and an adjustment means interconnecting the fixed support and the movable support for altering the position of the movable support with respect to the fixed support, wherein said movable support is movable with respect to the fixed support in response to operation of the adjustment means to adopt a selected position so that tension applied to the cutting elements of both arrays is maintained at a preselected level by the tensioning means.

2. A cutting device according to claim 1 in which the cutting elements are individual cutters in which the cutters are substantially circular, elliptical, or are of an eccentric shape and are provided with one or more cutting surfaces or edges.

3. A cutting device according to claim 1 in which the cutting elements of one array are arranged alternately with the cutting elements of an adjacent array so that the cutting elements of one array co-operatively interact with the cutting elements of an adjacent array on either side of the one array.

4. A cutting device according to claim 1 in which the movable support includes two plates arranged substantially perpendicularly to each other.

5. A cutting device according to claim 4 in which the adjustment means is associated with one of the plates whereas the tensioning means is associated with the other of the plates.

6. A cutting device according to claim 5 in which one of the plates is substantially vertically arranged and is provided with the adjustment means whereas the other of the plates is arranged substantially horizontally and is provided with the tensioning means.

7. A cutting device according to claim 6 in which the adjustment means further includes one or more screwjacks arranged in spaced apart relationship on the fixed support so that the movement of the screw jack or jacks effects movement of the movable support.

8. A cutting device according to claim 7 in which the one or more screwjacks are interconnected together to operate in unison to move the position of the movable support with respect to the fixed support.

9. A cutting device according to claim 1 in which the tensioning means includes two portions wherein one portion is provided on a first plate and the other portion is provided on a second plate, said first and second plates being movable with respect to each other, said plates being arranged so that one part of the tensioning means applies tension to one array of cutting elements and the other part of the tensioning means applies tension to another of the arrays.

10. A cutting device according to claim 9 in which the two parts of the tensioning means are interconnected by an interconnection means, so that movement of the interconnection means controls the amount of tension applied to both parts of the tensioning means.

11. A cutting device according to claim 10 in which the interconnection means is a drive shaft.

12. A cutting device according to claim 11 in which the drive shaft is a telescopic drive shaft.

13. A cutting device according to claim 10 in which the same tension is applied to both cutting arrays by the tensioning means.

14. A cutting device according to claim 1 in which each cutting array is supported by one or more bearing arrangements having one or more bearings in which at least one of the bearings forming the bearing arrangement is located intermediate the ends of the cutting array.

15. A cutting device according to claim 14 in which at least one of the bearing arrangements is located intermediate the ends of the cutting array and is a slideable bearing.

16. A cutting device according to claim 15 in which the slideable bearing arrangement includes an eccentric shaft which oscillates in use to clear the cutting elements as they rotate in use.

17. A cutting device according to claim 16 in which selected cutting elements contact a portion of the eccentric shaft to maintain the shaft free of the rotating cutters in use.

18. A cutting device according to claim 1 in which the tensioning means includes at least two coiled torsion springs in which one of the springs applies tension to one of the arrays and the other spring applies tension to the other array.

19. A cutting device according to claim 1, further including introduction means for introducing material to the cutting device, wherein said introduction means is movable or telescopic so that the introduction means moves in accordance with corresponding movement of the movable support with respect to the fixed support.

20. A cutting device according to claim 19 in which the introduction means is telescopic and moves telescopically in accordance with corresponding movement of the movable support.

21. A cutting device according to claim 19 in which the introduction means is a chute having a tapering mouth portion for receiving material to be shredded and a throat portion for directing the material to be shredded to the cutting arrays.

22. A cutting device according to claim 1 in which the cutting elements are provided with surface irregularities, wherein each cutting element is oriented so that the surface irregularities of one cutter are positioned intermediate the surface irregularities of adjacent cutting elements so that when the cutting elements counter-rotate with respect to each other the surface irregularities intermesh in turn to facilitate shredding of material between the cutting elements.

23. A cutting device according to claim 22 in which the surface irregularities are cleats.

24. A cutting device according to claim 1 in which the tensioning means is adjusted by the adjustment means in accordance with wear caused to the cutting elements during use of the device.

25. A cutting device according to claim 24 in which the tensioning means is adjusted in accordance with wear to the cutting edges of the cutting elements.

26. A cutting device according to claim 1 in which the cutting arrays are supported at each end thereof by a compound bearing arrangement including a first bearing located within a second bearing allowing displacement movement of the cutting arrays towards and away from one another.

27. A cutting device according to claim 1 in which the device further includes adjustment means for adjusting the relative position of the fixed and movable supports and an adjustment means for adjusting the amount of tension applied to the cutting elements, wherein both adjustment means are independently operable with respect to each other and co-operate with each other to maintain the cutting arrays under constant tension.

28. A cutting device according to claim 1 wherein said adjustment means interconnects the fixed support and the movable support for axially altering the position of the movable support with respect to the fixed support, wherein the movable support is movable with respect to the fixed support in response to operation of the adjustment means to adopt an axially selective position.

* * * * *